US007572565B2

(12) United States Patent
Young et al.

(10) Patent No.: US 7,572,565 B2
(45) Date of Patent: Aug. 11, 2009

(54) CARRIER PARTICLE COMPOSITIONS FOR XEROGRAPHIC DEVELOPERS

(75) Inventors: Eugene F. Young, Rochester, NY (US); Thomas C. Dombroski, Rochester, NY (US); Deepak R. Maniar, Webster, NY (US); Mark S. Jackson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 316 days.

(21) Appl. No.: 11/279,508

(22) Filed: Apr. 12, 2006

(65) Prior Publication Data

US 2007/0243480 A1 Oct. 18, 2007

(51) Int. Cl.
*G03G 9/113* (2006.01)

(52) U.S. Cl. ..... 430/111.41; 430/111.32

(58) Field of Classification Search ..... 430/111.32, 430/111.33, 111.35, 111.41; 399/252
See application file for complete search history.

(56) References Cited

U.S. PATENT DOCUMENTS

| | | | | |
|---|---|---|---|---|
| 3,590,000 | A | 6/1971 | Palermiti et al. | |
| 4,912,005 | A * | 3/1990 | Goodman et al. | 430/111.32 |
| 4,935,326 | A | 6/1990 | Creatura et al. | |
| 4,937,166 | A | 6/1990 | Creatura et al. | |
| 5,196,803 | A | 3/1993 | Cellini, Jr. et al. | |
| 5,336,579 | A * | 8/1994 | Zimmer et al. | 430/111.35 |
| 5,512,403 | A * | 4/1996 | Tyagi et al. | 430/111.33 |
| 5,928,830 | A | 7/1999 | Cheng et al. | |
| 6,042,981 | A | 3/2000 | Barbetta et al. | |
| 6,355,391 | B1 | 3/2002 | Van Dusen et al. | |
| 6,764,799 | B2 | 7/2004 | Skorokhod et al. | |
| 2006/0199094 | A1 * | 9/2006 | Grande et al. | 430/111.32 |
| 2007/0202428 | A1 | 8/2007 | Maniar et al. | |

FOREIGN PATENT DOCUMENTS

| | | | |
|---|---|---|---|
| EP | 990 954 | A1 * | 4/2000 |
| JP | 55028001 | A * | 2/1980 |
| JP | 61080263 | A * | 4/1986 |
| JP | 02064655 | A * | 3/1990 |
| JP | 06332266 | A * | 12/1994 |
| JP | 08202085 | A * | 8/1996 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
English language machine translation of JP 08-202085 (1996).*
Borsenberger, Paul M. and David Weiss. Organic Photoreceptors for Imaging Systems. New York: Marcel-Dekker, Inc. (1993) pp. 6-17.*
English language translation of JP 06-332266 (Dec. 1994).*
Co-pending U.S. Appl. No. 11/276,435, filed Feb. 28, 2006.

* cited by examiner

*Primary Examiner*—Christopher RoDee
(74) *Attorney, Agent, or Firm*—Oliff & Berridge, Plc.

(57) ABSTRACT

Carrier includes a mixture of carrier particles. The mixture may contain first carrier particles containing carrier cores that are coated with a polymer coating, the coating containing polymer and conductive particles, and second carrier particles containing carrier cores that are not coated with a polymer coating. The mixture may contain carrier particles having a conductivity of at least about $5\times10^{-8}$ (ohm-cm)$^{-1}$ and carrier particles having a conductivity of less than about $1\times10^{-8}$ (ohm-cm)$^{-1}$.

6 Claims, 5 Drawing Sheets

CARRIER PARTICLE COMPOSITIONS FOR XEROGRAPHIC DEVELOPERS

TECHNICAL FIELD

The present disclosure relates to carrier compositions containing a mixture of different carrier particles. The carrier compositions may be used in xerographic processes and devices.

REFERENCES

U.S. Pat. No. 4,935,326 discloses a carrier and developer composition, and a process for the preparation of carrier particles with substantially stable conductivity parameters which comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidenefluoride and polyethylene; polymethyl methacrylate and copolyethylene vinyl acetate; copolyvinylidenefluoride tetrafluoroethylene and polyethylenes; copolyvinylidenefluoride tetrafluoroethylene and copolyethylene vinyl acetate; and polymethyl methacrylate and polyvinylidenefluoride.

There is illustrated in U.S. Pat. No. 6,042,981 carriers including a polymer coating wherein the polymer coating may contain a conductive component, such as carbon black, and which conductive component, may be dispersed in the polymer coating. The conductive component is incorporated into the polymer coating of the carrier core by combining the carrier core, polymer coating, and the conductive component in a mixing process such as cascade roll mixing, tumbling, milling, shaking, electrostatic powder cloud spraying, fluidized bed, electrostatic disc processing or by an electrostatic curtain. After the mixing process, heating is initiated to coat the carrier core with the polymer coating and conductive component.

U.S. Pat. No. 6,355,391 describes a micro-powder that can be used as a coating for carrier core particles. The micro-powder includes a sub-micron sized powder recovered from a synthetic latex emulsion of polymer and surfactant, and a conductive filler incorporated into the powder. The patent indicates that, in embodiments, the polymer is a methyl methacrylate polymer or copolymer. The conductive filler may be any suitable material exhibiting conductivity, e.g., metal oxides, metals, carbon black, etc. The patent also discloses incorporating the micro-powder onto the surface of carrier, followed by heating.

There is illustrated in U.S. Pat. No. 6,764,799 carrier comprised of a core and thereover a polymer coating, the polymer coating being generated by the emulsion polymerization of one or more monomers and a surfactant. This patent specifically indicates that the coated carriers are substantially free of or free of conductive components like conductive carbon blacks.

The appropriate components and process aspects of the foregoing may be selected for the present disclosure in embodiments thereof, and the entire disclosure of the above-mentioned patents is totally incorporated herein by reference.

BACKGROUND

The electrostatographic process, and particularly the xerographic process, is known. This process involves the formation of an electrostatic latent image on a photoreceptor, followed by development of the image with a developer, and subsequent transfer of the image to a suitable substrate. In xerography, the surface of an electrophotographic plate, drum belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Numerous different types of xerographic imaging processes are known wherein, for example, insulative developer particles or conductive developer particles are selected depending on the development systems used. Moreover, of importance with respect to the aforementioned developer compositions is the appropriate triboelectric charging values associated therewith, as it is these values that enable continued formation of developed images of high quality and excellent resolution. In two component developer compositions, carrier particles are used in charging the toner particles.

Carrier particles in part comprise a roughly spherical core, often referred to as the "carrier core," which may be made from a variety of materials, such as magnetic materials. The core is often coated with a resin. This resin may be made from a polymer or copolymer. The resin may have conductive material or charge enhancing additives incorporated into it to provide the carrier particles with more desirable and consistent triboelectric properties. The resin may be in the form of a powder, which may be used to coat the carrier particle. Often the powder or resin is referred to as the "carrier coating" or "coating."

Known methods of incorporating conductive material into carrier coating include the use of electrostatic attraction, mechanical impaction, in-situ polymerization, dry-blending, thermal fusion and others. These methods of incorporating conductive material into carrier coatings often result in only minimal amounts of conductive material being incorporated into the coating or produces conductive carrier coatings too large for effective and efficient use in some of the smaller carriers. Other conductive coating resins use dry-blending processes and other mixing to incorporate the carbon black or other conductive material into the polymer. However, in order to avoid transfer of carbon black from conductive polymers so obtained, the amount of carbon black that can be blended is severely limited, e.g., to 10% by weight or less. This in turn severely limits the conductivity achievable by the resultant conductive polymer.

In addition to the problems associated with loading conductive materials into coating resins, recent efforts to advance carrier particle science have focused on the attainment of coatings for carrier particles to improve development quality and provide particles that can be recycled and that do not adversely affect the imaging member in any substantial manner. Many of the present commercial coatings can deteriorate rapidly, especially when selected for a continuous xerographic process where the entire coating may separate from the carrier core in the form of chips or flakes causing failure upon impact or abrasive contact with machine parts and other carrier particles. These flakes or chips, which cannot generally be reclaimed from the developer mixture, have an adverse effect on the triboelectric charging characteristics of the carrier particles, thereby providing images with lower resolution in comparison to those compositions wherein the carrier coatings are retained on the surface of the core substrate.

Further, another problem encountered with some prior art carrier coatings resides in fluctuating triboelectric charging characteristics, particularly with changes in relative humidity. High relative humidity hinders image density in the xerographic process, may cause background deposits, leads to developer instability, and may result in an overall degeneration of print quality. In the science of xerography, the term "A Zone" is used to refer to hot and humid conditions, while the term "C Zone" is used to refer to cold and dry conditions. Triboelectric charges are usually lower in the "A Zone" than in the "C Zone." It is desirable to have the measured triboelectric charges ($_{tc}$) for a particular carrier in the A Zone and the C Zone, when entered into a ratio of A zone$_{tc}$/C zone$_{tc}$, to be close to 1.0 in order to obtain good development in high humidity.

A carrier coating commonly used is #MP-116 PMMA available from Soken Chemical in Japan. This powder typically has a diameter of 0.4 to 0.5 micrometers and is a made from polymethyl methacrylate. However, it is required to use high amounts of #MP-116 PMMA to coat 30 to 150 micrometer carrier cores to achieve surface area coverage on the carrier of 85% to 95%. Use of such high amounts of carrier coating often results in lower carrier yields due to fused aggregates. Fused aggregates must be broken up or removed by screening. Crushing or breaking up of the aggregates may result in weak or "chipped off" areas on the carrier surface potentially causing poor coating quality. Screen separation may result in a lower yield as aggregates are removed from the final product.

Various coated carrier particles for use in electrostatographic developers are known in the art. Carrier particles for use in the development of electrostatic latent images are described in many patents including, for example U.S. Pat. No. 3,590,000. These carrier particles may comprise various cores, including steel, with a coating thereover of fluoropolymers and ter-polymers of styrene, methacrylate, and silane compounds.

There is a continuing need to be able to incorporate conductive material into coating resins while providing for and maintaining desirable xerographic qualities such as high coating efficiency, proper performance, and stable charging characteristics.

SUMMARY

In embodiments, the present disclosure is directed to carrier comprising a mixture of conductive carrier particles and insulative carrier particles. In particular, the present disclosure describes carrier comprising carrier particles that have a detoned conductivity of at least $5\times10^{-8}$ (ohn-cm)$^{-1}$ and carrier particles that have a detoned conductivity of less than $1\times10^{-8}$ (ohm-cm)$^{-1}$.

In embodiments, the present disclosure is directed to carrier comprising: first carrier particles comprising carrier cores that are coated with a polymer coating, the coating comprising polymer and conductive particles, and second carrier particles comprising carrier cores that are not coated with a polymer coating.

In embodiments, the present disclosure is directed to developer comprising carrier described herein with toner on the surface thereof. In embodiments, the present disclosure is directed to a xerographic device comprising an image forming member and a housing containing developer described herein.

BRIEF DESCRIPTION OF THE DRAWINGS

Various exemplary embodiments of the disclosure will be described in detail, with reference to the following figures, wherein.

EMBODIMENTS

Figure 1:
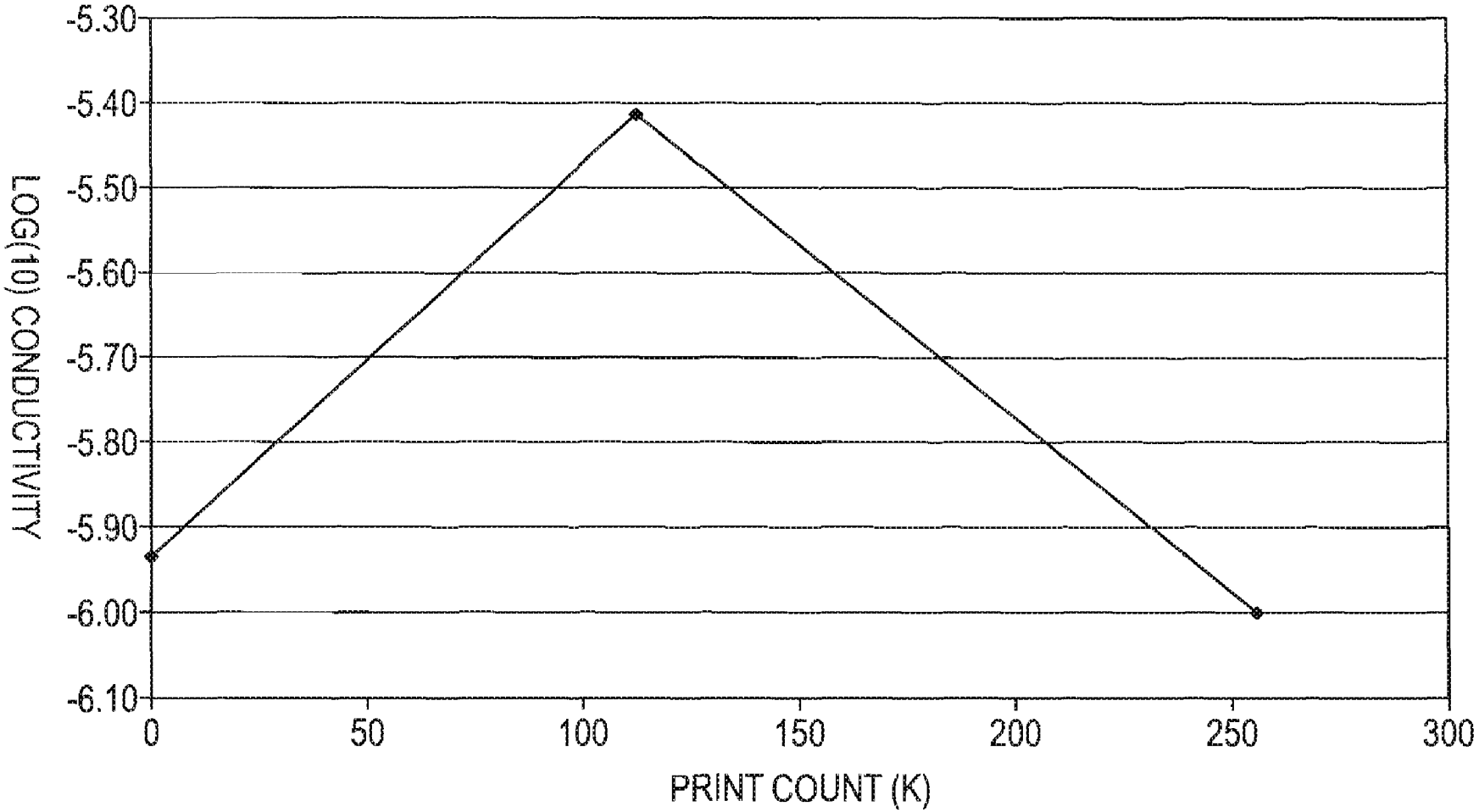
FIG. 1 shows a plot of $\log_{10}$ conductivity as a developer ages.

In making copies, there can be a loss of halftone rendition at high and low percent area coverage. That is, there is a non-linearity in the tone reproduction curve. It was found that, with at least some developers, improvement occurred as the developer aged. In particular, when the 10 volt detoned developer conductivity of a particular developer was measured as a function of time it was found that it first increased and then decreased with time. This is shown in FIG. 1 as the $\log_{10}$ conductivity versus print count. It was further observed that the tone reproduction curve became more linear as the conductivity decreased. This observation lead to the idea of mixing conductive carrier with insulative carrier to change the initial conductivity of the developer to make it more like the aged developer. Thus, in embodiments, the present disclosure is directed to carrier comprising a mixture of conductive carrier particles and insulative carrier particles.

The term "conductive carrier particles" refers, for example, to carrier particles that have a detoned conductivity of at least about $5\times10^{-8}$ (ohm-cm)$^{-1}$, such as carrier particles having a detoned conductivity of from about $1\times10^{-7}$ (ohm-cm)$^{-1}$ to about $1\times10^{-6}$ (ohm-cm)$^{-1}$.

The term "insulative carrier particles" refers, for example, to carrier particles that have a detoned conductivity of less than about $1\times10^{-8}$ (ohm-cm)$^{-1}$, such as carrier particles having a detoned conductivity of from about $1\times10^{-12}$ (ohm-cm)$^{-1}$ to about $1\times10^{-8}$ (ohm-cm)$^{-1}$.

In embodiments, the carrier core of the conductive and/or insulative carrier particles are magnetic. In embodiments, the carrier core of the conductive and/or insulative carrier particles comprise metal oxide, such as magnetite.

In embodiments, the conductive carrier particles comprise carrier cores that are coated with a polymer coating, the coating comprising polymer and conductive particles.

In embodiments, the insulative carrier particles comprise carrier cores that are not coated with a polymer coating.

In embodiments, the carrier comprises from about 5 to about 95 weight percent conductive carrier particles and from about 5 to about 95 weight percent insulative carrier particles, such as from about 40 to about 80 weight percent conductive carrier particles and from about 20 to about 60 weight percent insulative carrier particles.

In embodiments, the present disclosure is directed to carrier comprising: first carrier particles comprising carrier cores that are coated with a polymer coating, the coating comprising polymer and conductive particles, and second carrier particles comprising carrier cores that are not coated with a polymer coating.

In embodiments, the carrier comprises from about 5 to about 95 weight percent first carrier particles and from about 5 to about 95 weight percent second carrier particles, such as from about 40 to about 80 weight percent first carrier particles and from about 20 to about 60 weight percent second carrier particles.

In embodiments, the carrier core of the coated and/or uncoated carrier particles are magnetic. In embodiments, the carrier core of the coated and/or uncoated carrier particles comprise metal oxide, such as magnetite.

The polymer of the polymer coating is generally a polymer that will form a good coat on the carrier. In embodiments, the polymer is an acrylic polymer. In embodiments, the acrylic polymer is polymethylmethacrylate (PMMA) polymer or copolymer. Suitable comonomers that may be used to form a PMMA copolymer include, for example, monoalkyl or dialkyl amines such as dimethylaminoethyl methacrylate, diethylaminoethyl methacrylate, diisopropyl aminoethyl methacrylate, acrylic or methacrylic acids, or fluoroalkyl or perfluorinated acrylic and methacrylic esters, such as, for example fluoro-ethyl methacrylate, such as 2,2,2-trifluoroethyl methacrylate, or fluoro-ethylacrylate.

The coating may be adhered to the core by powder coating. In particular, conductive particles coated with conductive polymer can be mixed with polymer particles. The particle mixture can then be mixed with the carrier and heated to fuse the particles to the carrier core. However, the coating may be adhered to the core by other methods, such as solution coating, in situ polymerization and emulsion aggregation.

The conductive particles in the polymer coating may comprise carbon black and/or another conductive material, such as metal or metal oxides.

The conductive particles may have a size of, for example, from about 0.012 micrometers to about 0.5 micrometers. In embodiments, these conductive particles have a size of, for example, from about 0.02 micrometers to about 0.05 micrometers.

The conductive particles coated with conductive polymer may be incorporated with the polymer particles using techniques known in the art including the use of various types of mixing and/or electrostatic attraction, mechanical impaction, dry-blending, thermal fusion and others.

In addition to incorporating conductive particles into carrier coatings, it is often desirable to impart varying charge characteristics to the carrier particle by incorporating charge enhancing additives. If incorporated with the polymer particles, the charge enhancing additives may be incorporated in a premixing process before or after the incorporation of the conductive particles.

Typical charge enhancing additives include particulate amine resins, such as melamine, and certain fluoro polymer powders such as alkyl-amino acrylates and methacrylates, polyamides, and fluorinated polymers, such as polyvinylidine fluoride ($PVF_2$) and poly(tetrafluoroethylene), and fluoroalkyl methacrylates such as 2,2,2-trifluoroethlyl methacrylate.

Other charge enhancing additives such as, for example, those illustrated in U.S. Pat. No. 5,928,830, incorporated by reference herein, including quaternary ammonium salts, and more specifically, distearyl dimethyl ammonium methyl sulfate (DDAMS), bis-1-(3,5-disubstituted-2-hydroxy phenyl) axo-3-(mono-substituted)-2-naphthalenolato(2-)chromate (1-), ammonium sodium and hydrogen (TRH), cetyl pyridinium chloride(CPC), FANAL PINK™ D4830, and the like and others as specifically illustrated therein may also be utilized in the present disclosure.

The charge additives may be added in various effective amounts, such as from about 0.5% to about 20% by weight, based on the stun of the weights of all polymer, conductive particles, and charge additive components.

In an embodiment, the polymer coating is used to coat carrier cores of any known type by any known method, which carriers are then incorporated with any known toner to form a developer for xerographic printing. Suitable carrier cores may be found in, for example, U.S. Pat. Nos. 4,937,166 and 4,935,326, incorporated herein by reference, and may include granular zircon, granular silicon, glass, steel, nickel, ferrites, magnetites, iron ferrites, silicon dioxide, and the like.

Carrier cores having a diameter in a range of, for example, about 5 micrometers to about 100 micrometers may be used. In embodiments, the carriers are, for example, about 20 or about 30 micrometers to about 80 or about 70 micrometers.

Typically, the coating covers, for example, about 60% to about 100% of the surface area of the carrier core using about 0.1% to about 3.0% coating weight. In embodiments, about 75% to about 98% of the surface area is covered with the coating using about 0.3% to about 2.0% coating weight. In embodiments, surface area coverage is about 85% to about 95% using about 1% coating weight.

Use of smaller-sized coating powders has proven more advantageous as a smaller amount by weight of the coating is needed to sufficiently coat a carrier core. Using less coating is cost effective and results in less coating separating from the carrier to interfere with the tribolelectric charging characteristics of the toner and/or developer.

In embodiments, the carrier described herein provides a developer that, after developing 2500 prints, has an output L* plotted against input percent halftone having a correlation coefficient $R^2$ of from about 0.95 to 1.0. In embodiments, the carrier has a $\log_{10}$ detoned conductivity of about −5.8 $(\text{ohm-cm})^{-1}$ or lower, such as about −7.0 $(\text{ohm-cm})^{-1}$ or lower, before the developer is used to develop images. In embodiments, the carrier has a $\log_{10}$ detoned conductivity from about −5.8 $(\text{ohm-cm})^{-1}$ to about $\log_{10}$-7.5 $(\text{ohm-cm})^{-1}$ before the developer is used to develop images. In embodiments, the developer has an S-ness Figure of Merit of about 3.5 or lower before the developer is used to develop images.

In embodiments, the present disclosure is directed to a xerographic device comprising such a developer. In the xerographic device, the developer described herein may be used with any suitable imaging member to form and develop electrostatic latent images.

EXAMPLES

The following examples illustrate specific embodiments of the present disclosure. One skilled in the art would recognize that the appropriate reagents, component ratio/concentrations may be adjusted as necessary to achieve specific product characteristics. All parts and percentages are by weight unless otherwise indicated.

In the following examples, conductivity of the developer is a detoned developer conductivity. To measure the conductivity, toner is removed from the carrier and the conductivity is measured at 10 volts using the device described in U.S. Pat.

No. 5,196,803. The tribo and toner concentration (TC) are measured according to the ASTM procedure F1425-92 at an air pressure of 55 pounds per square inch.

Developers were formed by physically mixing carrier and toner in a jar mill. The first carrier, which is referred to below as the "coated carrier," contained a 65 μm magnetite core solvent coated with a coating comprising PMMA and carbon black. The coating weight was approximately 2.1%. The conductivity of the coated carrier was $8.54\times10^{-7}$ (ohm-cm)$^{-1}$. The log of the conductivity was −6.07. The second carrier, referred to below as the "uncoated carrier," was a 65 μm magnetite core. The conductivity of the uncoated carrier was $8.25\times10^{-9}$ (ohm-cm)$^{-1}$. The log of the conductivity was −8.08. The toner was Xerox 6R1046 (555/545/535), which is a polyester-based toner. The toner concentration (TC) was 4%.

The carriers were mixed in the following amount to form developers. In Example 1, the carrier contained 10 percent by weight uncoated carrier and 90 percent by weight coated carrier. In Example 2, the carrier contained 30 percent by weight uncoated carrier and 70 percent by weight coated carrier. In Example 3, the carrier contained 50 percent by weight uncoated carrier and 50 percent by weight coated carrier. In Example 4, the carrier contained 70 percent by weight uncoated carrier and 30 percent by weight coated carrier. In Example 5, the carrier contained 90 percent by weight uncoated carrier and 10 percent by weight coated carrier.

Developers formed from the mixtures of Examples 1-5 were compared to two comparative developers. In Comparative Example 1, all of the carrier was the coated carrier. The triboelectric charge on the carrier in Comparative Example 1 was 23.3 μC/g. In Comparative Example 2, all of the carrier was the uncoated carrier.

The developers of Examples 1-5 and Comparative Example 1 were tested using a Xerox Work Centre 165 machine. The results of these tests are depicted in FIGS. 2-5.

Figure 2:
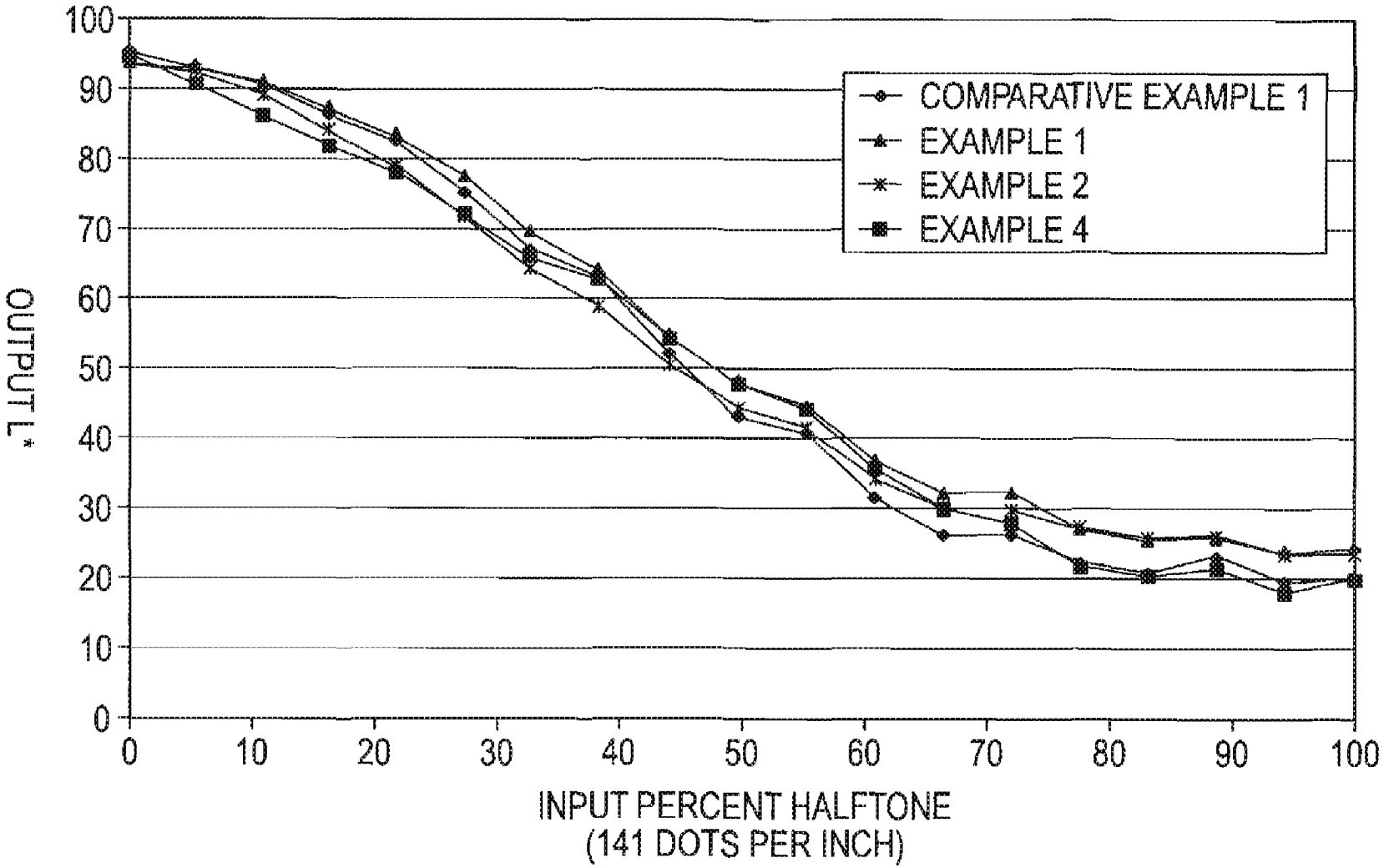
FIG. 2 shows a plot of halftone reproduction versus percent halftone input after 500 prints.

FIG. 2 shows a plot of L* ($L^*\sim1/10^{D/3}$) of a halftone reproduction versus the percent halftone input after 500 prints, where D is the reflection optical density. The curve with diamonds is the control developer where all of the carrier is the coated carrier. At low percent halftone input, the curve has a fair amount of curvature. This can be contrasted with the curve where the developer is made with 70% uncoated carrier and 30% coated carrier (Example 4). It is more linear.

Figure 3:
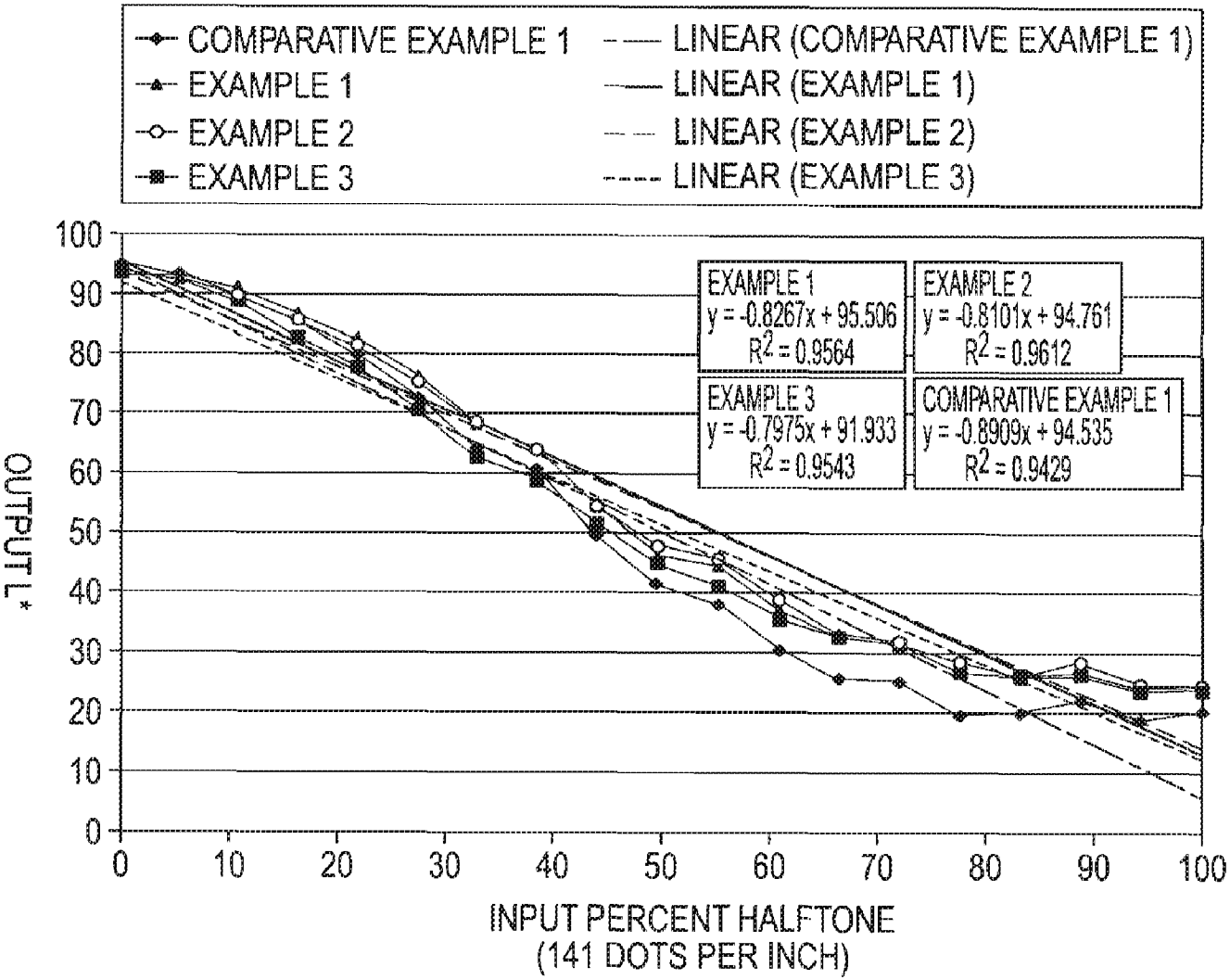
FIG. 3 shows a plot of halftone reproduction versus percent halftone input after 2500 prints.

FIG. 3 shows the same thing at 2,500 prints. A print is one cycle of the development process which results in an image fused to the paper or other media. Thus, 2500 prints would have created 2500 documents with an image of some sort on the paper. In FIG. 3, the regression lines are included. As depicted therein, the $R^2$ is better for the experimental carriers as compared to the comparative carrier. The effects of these changes are more evident in the prints, where it can be seen that, for the 30/70 and higher mixtures, there is an improvement in the definition of the highlights and in the shadow (dark) areas that show greater contrast differences. That is, it is possible to distinguish two shadow areas with greater clarity with the mixed carrier developers than with the pure coated carrier developer.

Figure 4:
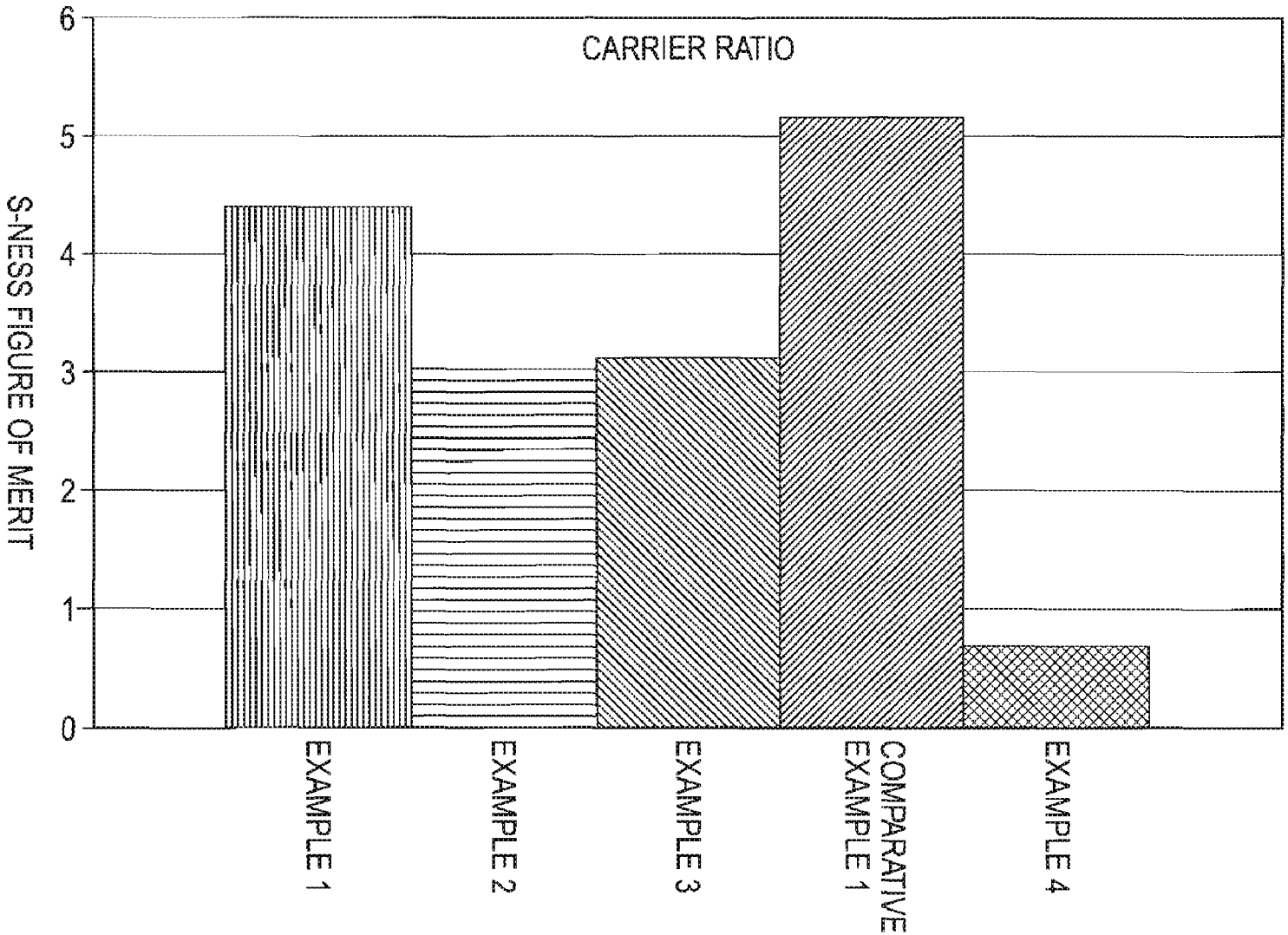
FIG. 4 shows the S-ness figure of merit for carriers of the present disclosure.

To further show this effect, an S-ness figure of merit is depicted in FIG. 4. S-ness=L*(at 20% input halftone)+0.4×(60-L*(at 50% halftone)−82. The S-ness is ideally less than 2.5 but numbers around 3 are considered to be acceptable. Here the 30/70 ratio (Example 2) and the 50/50 ratio (Example 3) are around 3 while the 70/30 ratio (Example 4) is at 0.7. In contrast, the S-ness of Comparative Example 1 is greater than 5.

The improvements achieved by including uncoated carrier with the coated carrier comes at a price. In particular, the Tribo or Tribo product increases as the uncoated carrier to coated carrier ratio increases, the tribo product being the tribo multiplied by the toner concentration. As the ratio goes above about 70/30, the tribo (tribo product) gets into the region where the developability begins to fall off and print quality is affected.

Figure 5:
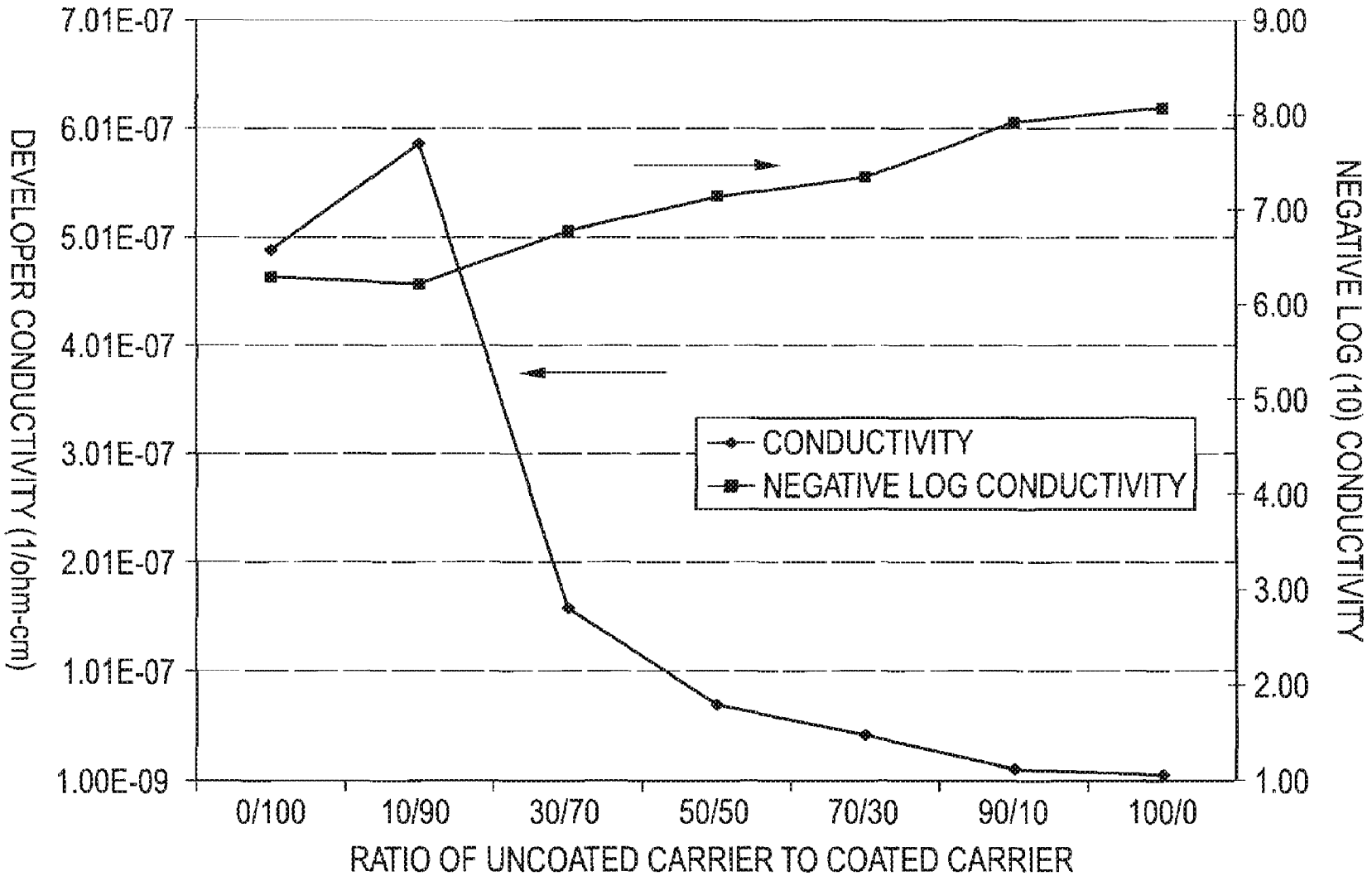
FIG. 5 shows the conductivity for carriers of the present disclosure.

FIG. 5 shows the effect on detoned developer conductivity. The data shows a drop off in conductivity after 10/90. Thus, taking into account the desired Tribo properties, the optimum ratio may be in the region of from 30/70 to 70/30, optionally from 30/70 to 50/50, uncoated carrier to coated carrier.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A developer comprising a carrier and a toner on the surface of the carrier, wherein the carrier comprises a mixture of:

(a) first carrier particles comprising magnetite carrier cores that are coated with a polymer coating, the coating comprising a polymer and conductive particles; and (b) second carrier particles comprising magnetite carrier cores that are not coated with a polymer coating, wherein:

the first carrier particles have a detoned conductivity from about $1\times10^{-7}$(ohm-cm)$^{-1}$ to about $1\times10^{-6}$(ohm-cm)$^{-1}$; and the second carrier particles have a detoned conductivity of less than about $1\times10^{-8}$ (ohm-cm)$^{-1}$.

2. The developer according to claim 1, wherein the carrier has a $\log_{10}$ detoned conductivity of about −5.8 (ohm-cm)$^{-1}$ or lower.

3. The developer according to claim 1, wherein the carrier has a $\log_{10}$ detoned conductivity of from about −5.8 (ohm-cm)$^{-1}$ to about −7.5 (ohm-cm)$^{-1}$.

4. The developer according to claim 1, wherein the carrier has a $\log_{10}$ detoned conductivity of about −7.0 (ohm-cm)$^{-1}$ or lower.

5. The developer according to claim 1, wherein the first carrier particles and the second carrier particles are magnetic.

6. The developer according to claim 1, wherein the second carrier particles have a detoned conductivity from about $1\times10^{-12}$ (ohm-cm)$^{-1}$ to about $1\times10^{-8}$ (ohm-cm)$^{-1}$.

* * * * *